United States Patent [19]

Stratton

[11] 4,340,146

[45] Jul. 20, 1982

[54] DISPOSABLE COASTER

[76] Inventor: John R. Stratton, 6735 Churchill Way, Dallas, Tex. 75230

[21] Appl. No.: 101,487

[22] Filed: Dec. 10, 1979

[51] Int. Cl.[3] ..... B65D 23/06

[52] U.S. Cl. ..... 215/100.5; D7/45; 428/181

[58] Field of Search ..... D7/45; 248/346.1; 362/101; 428/64, 35, 181, 192, 153; 215/100.5

[56] References Cited

U.S. PATENT DOCUMENTS

| | | | |
|---|---|---|---|
| 1,683,205 | 9/1928 | Packard | D7/45 X |
| 1,959,134 | 5/1934 | Martin | D7/45 X |
| 2,546,874 | 3/1951 | Siegrist | 428/35 X |
| 2,731,056 | 1/1956 | Anson | 215/100.5 |
| 2,990,968 | 7/1961 | Pirman | 215/100.5 |
| 3,161,394 | 12/1964 | Savitt | 248/346.1 |
| 3,195,847 | 7/1965 | Squires | 248/346.1 |
| 3,257,092 | 6/1966 | Blundell | 248/346.1 |
| 3,348,800 | 10/1967 | Wiechers | 248/346.1 |
| 3,357,590 | 12/1967 | Safford | 215/100.5 X |
| 4,125,656 | 11/1978 | Creamer | 428/181 X |

*Primary Examiner*—Henry F. Epstein
*Attorney, Agent, or Firm*—Dennis T. Griggs

[57] ABSTRACT

A disposable coaster for use with a beverage container is characterized by a substrate of moisture absorbent material having a base panel and an upstanding side wall joined to the base panel, thereby forming an open ended shell for receiving the bottom end of the beverage container, with the upstanding side wall being characterized by folded, overlapping side wall segments defining vertically extending pleats. A film deposit of moisture impervious sealing material applied to the exterior surface of the shell strengthens the pleats, improves tear resistance and prevents leakage.

1 Claim, 6 Drawing Figures

DISPOSABLE COASTER

BACKGROUND OF THE INVENTION

1. Field of the Invention

The present invention relates to coasters for use with drinking glasses and the like.

2. Description of the Prior Art

A coaster is a small mat, dish, or tray which is placed under an object such as a drinking glass to protect a surface from exposure to moisture or scratching. Perhaps the most commonly used coaster is simply a paper napkin or fiber towel which is placed under or wrapped around the bottom of a glass. Such an arrangement has good moisture absorbency, but when saturated, tends to tear apart very easily, and therefore can be used for only a short period before it must be replaced.

Another popular coaster is a cork disk or a plastic tray having a well for accumulating moisture which forms on the outside of a drinking glass. Such coasters are used primarily to prevent the formation of a water mark on furniture. A disadvantage which is common to both cork and plastic coasters alike is that a partial vacuum often forms beneath the bottom end of the glass and the coaster surface, which causes the coaster to adhere to the bottom of the glass as the glass is lifted. When this occurs, and as the glass is lifted and tilted, the partial vacuum is released whereupon the coaster falls to the floor or onto the clothing of the person holding the glass.

SUMMARY OF OBJECTS OF THE INVENTION

It is, therefore, the principal object of the present invention to provide a coaster having increased absorbency and tear resistance.

Another object of the invention is to provide a disposable, absorbent coaster which is inexpensive and may be manufactured by mass production techniques.

Yet another object of the invention is to provide a coaster for use with a drinking glass which when moistened will adhere securely to the bottom of the glass and will not fall when tilted.

A related object is to provide a disposable coaster structure having increased moisture accumulation and retention.

Another object of the invention is to provide a disposable, absorbent coaster having a soft, nonabrasive outer surface which can be safely used with furniture without risk of scratching or forming water marks.

SUMMARY OF THE INVENTION

According to novel aspects of the invention, the foregoing objects are achieved by a disposable coaster comprising a substrate of moisture absorbent material, such as paper, having a base section and an upstanding side wall joined to the base section, thereby forming an open ended shell for receiving the bottom end of a beverage container such as a drinking glass. The upstanding side wall is characterized by folded, overlapping side wall segments which define vertically extending pleats. A film deposit of moisture impervious sealing material is adhered to the outside surface of the moisture absorbent substrate, with the moisture absorbent substrate forming the inside surface of the shell, and the sealing film deposit forming the outside surface of the shell.

The outside surface of the shell is treated by spraying or otherwise applying a coating of wax, lacquer or other sealing material for the purposes of waterproofing the shell, and for stabilizing the pleats.

The sealing film deposit forms a nonabrasive, moisture resistant surface, and simultaneously strengthens the substrate to increase its tear resistance even though the substrate becomes saturated. The pleated side wall further stabilizes the upstanding configuration, while the overlapping side wall segments of the pleats substantially increase the amount of substrate material available for absorbing condensate.

The novel features which characterize the invention are defined by the appended claims. The foregoing and other objects, advantages and features of the invention will hereinafter appear, and for purposes of illustration of the invention, but not of limitation, an exemplary embodiment of the invention is shown in the appended drawing.

DETAILED DESCRIPTION OF THE PREFERRED EMBODIMENTS

Figure 1:
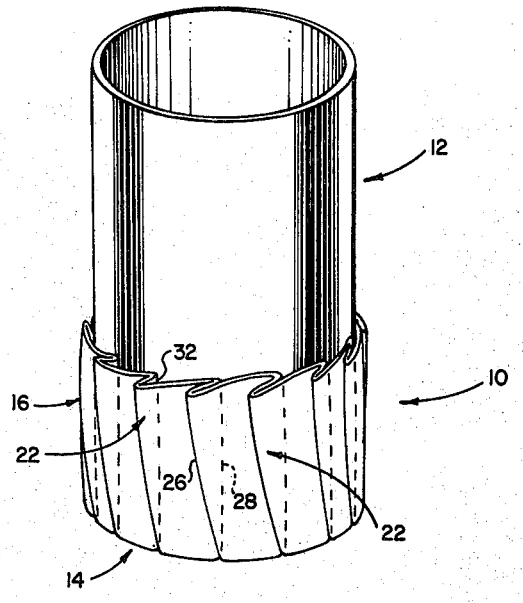
FIG. 1 is a perspective view of a coaster and drinking glass.
Figure 2:
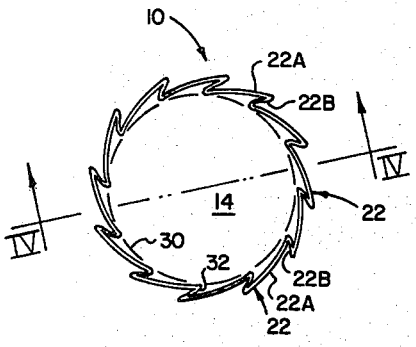
FIG. 2 is a top plan view of a coaster constructed according to the teachings of the invention.

In the description which follows, like parts are identified throughout the specification and drawings with the same reference numerals, respectively. The drawings are not necessarily to scale and in some instances, portions have been exaggerated to more clearly depict certain features of the invention.

Referring now to FIGS. 1–4, a coaster 10 is illustrated in a preferred embodiment as an open ended shell for receiving the bottom end of a drinking glass 12. The coaster 10 has a base section or panel 14 and an upstanding side wall 16 joined to the base section, thereby forming the open ended shell configuration.

The base panel and side wall preferably comprise double layer thicknesses 18A, 18B of a moisture absorbent substrate 18. Applied to the exterior surface of the substrate 18B is a sealing film deposit 20 of a suitable sealing material such as wax, lacquer or the like. According to this arrangement, the moisture absorbent substrate 18A forms the inside surface of the shell, and the sealing film deposit 20 forms the outside surface of the shell.

According to an important feature of the invention, the upstanding side wall 16 is characterized by folded, overlapping side wall segments 22A, 22B which define vertically extending pleats 22. This pleated side wall arrangement increases the strength and durability of the coaster structure, while the overlapping side wall segments 22A, 22B substantially increase the amount of substrate material available for absorbing condensate. The sealing film deposit forms a nonabrasive, moisture impervious surface, while simultaneously strengthening the substrate to increase its tear resistance even though it becomes saturated.

The substrate 18 preferably comprises a fibrous, moisture absorbent material such as is commonly used to produce paper towels, and the sealing film deposit 20 is preferably sprayed onto the exterior surface of the substrate prior to formation of the vertically extending pleats 22.

Figure 3:
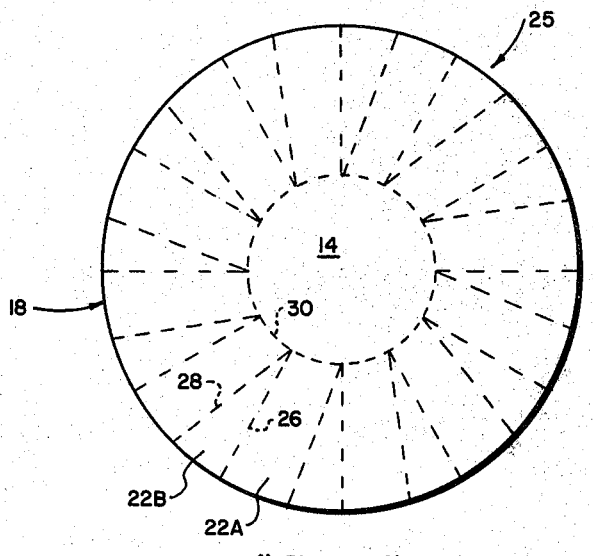
FIG. 3 is a top plan view of a substrate blank from which a coaster having a scalloped edge is made.
Figure 4:
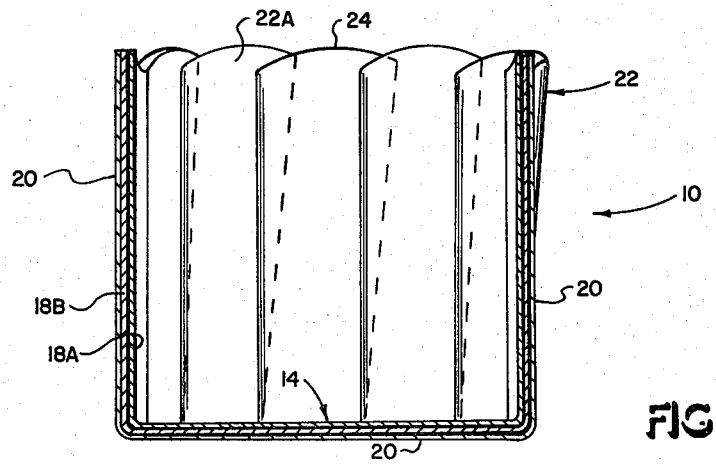
FIG. 4 is a sectional view of a coaster having a scalloped top edge, taken along the lines IV—IV of FIG. 2.

Referring to FIG. 4, the disposable coaster 10 is furnished with a scalloped top edge 24. The scalloped top edge is produced from a circular substrate blank 25 as illustrated in FIG. 3. The fold segments 22A, 22B are delineated by dashed fold lines 26, 28 which extend radially with respect to the circular boundary 30 of the base 14.

The disposable coaster 10 is fabricated by die cutting a single, double or more thickness of paper substrate 18 into the form of the circular blank 25. The sealing film deposit 20 is sprayed onto the exterior surface of the outmost substrate blank 18B, and thereafter the pleated shell configuration is produced automatically in a folding machine. The sealed pleats 22 substantially strengthen and stabilize the coaster structure. If desired, an additional sealing film deposit may be applied to the coaster after the pleats are formed.

The folded, vertically overlapping side wall segments 22A, 22B of each pleat define a reservoir for accumulating moisture or condensate. Because the pleats extend away from the outside surface of the glass 12, water or condensate is conveyed by capillary action away from the surface of the glass into the folds of each pleat. It will be appreciated the some condensate will form along the upper surface of the glass 12, and will flow downwardly along the outer surface of the glass until it contacts the innermost absorbent substrate layer 18A. Bridging or overflow of the condensate over the sealed sides cannot occur since the major fold 22A of each pleat is displaced with respect to the outer surface of the glass 12, thereby defining a radial gap or condensate flow passage 32 between the glass and substrate. Therefore if moisture or condensate is formed on the outside surface of the glass at a rate faster than the rate at which it is absorbed near the scalloped top edge, the excess condensate will drain through the flow passage 32 and will be absorbed by the inner substrate 18A as it flows downwardly along the side of the glass. It will be appreciated that this arrangement prevents dripping of condensate while substantially increasing the amount of substrate available to absorb the condensate.

Because the pleated side wall 16 and the bottom 14 are held in close contact against the outside surface of the glass 12, a partial vacuum is created when the substrate becomes saturated, which causes the coaster to cling securely to the bottom of the glass, even when the glass is tilted.

Figure 5:
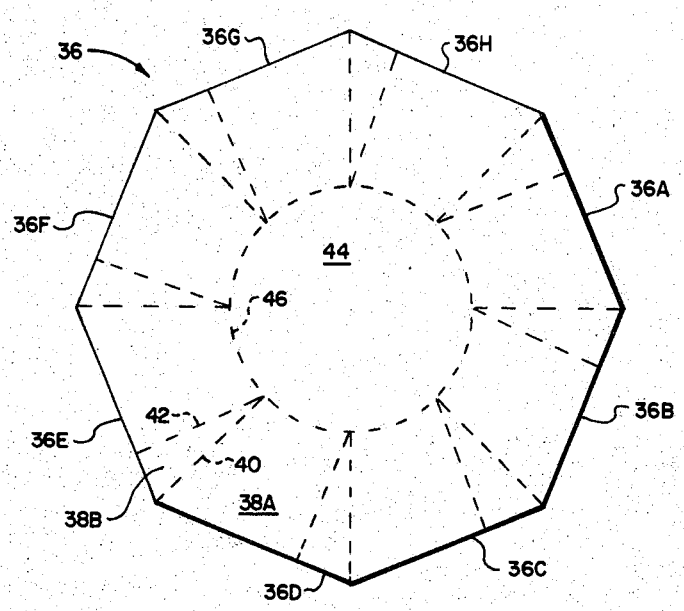
FIG. 5 is a top plan view of a substrate blank from which a coaster having a level top edge is made; and, FIG. 6 is a side elevation view of a coaster having a level top edge.
Figure 6:
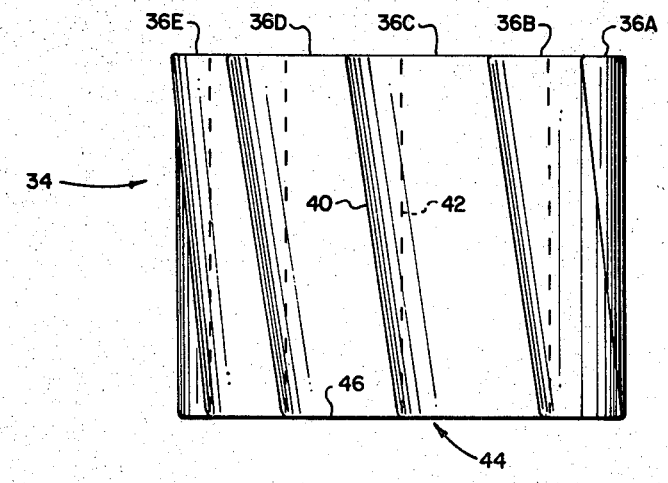

Referring now to FIGS. 5 and 6, a disposable coaster 34 is fabricated from a single thickness absorbent substrate blank 36. The substrate blank 36 has a perimeter in the shape of an octagon with eight edges 36A–36H. When folded along the fold lines 38, 40, the disposable coaster 34 is produced having a level top edge, with pleats 38 formed by major and minor pleat segments 38A, 38B, respectively. It should be apparent, therefore, that the top edge of the disposable coaster can be scalloped, level, or any one of a variety of geometrical patterns as desired. Additionally, the size of the pleat fold sections may be varied with respect to each other and with respect to the diameter of the coaster bottom.

Referring to FIG. 5, the major and minor fold segments 38A, 38B are partitioned by the dashed fold lines 40, 42. The fold line 40 extends radially with respect to the center of the bottom panel 44, while the fold line 42 is inclined with respect to the fold line 40 and intersects the fold line 40 at the circular boundary 46 of the bottom panel 44 to form a vertex. This fold arrangement produces a vertical crease adjacent the side wall of the glass, with an inclined crease extending outwardly at an angle.

A particularly useful fold arrangement, which is common to both the coaster 10 shown in FIG. 4, and the coaster 34 shown in FIG. 6, is that one fold line radiates substantially from the center of the bottom portion 14, while the other fold line forms a vertex with the first fold line but does not pass through the geometrical center of the bottom pattern. This fold arrangement produces a vertical crease extending along the outside surface of the drinking glass, and an inclined crease, as represented by the fold line 26 which projects radially outwardly with respect to the first fold line. This particular fold arrangement compresses uniformly as the coaster side wall 16 is pressed inwardly, thereby allowing the coaster to be used with a glass having a stem, such as a wine glass.

Referring to FIG. 5, the major and minor fold segments 38A, 38B are partitioned by the dashed fold lines 40, 42. The fold line 40 extends radially with respect to the center of the bottom panel 44, while the fold line 42 is inclined with respect to the fold line 40 and intersects the fold line 40 at the circular boundary 46 of the bottom panel 44 to form a vertex. This fold arrangement produces a vertical crease adjacent the side wall of the glass, with an inclined crease extending outwardly at an angle.

From the foregoing description of preferred embodiments of the invention, those skilled in the art will appreciate that the disposable coaster of the present invention represents a substantial improvement over conventional coaster devices. Although preferred embodiments of the invention have been described in detail, it should be understood that various changes and alterations can be made therein without departing from the spirit and scope of the invention as defined by the appended claims.

What is claimed is:

1. A disposable coaster for use with a beverage container comprising a substrate of moisture absorbent material, said substrate having a base panel and a pleated sidewall joined to the base panel thereby forming a shell having an open end, with the moisture absorbent substrate forming the inside surface of the shell, and a sealing film deposit applied to the outside surface of the shell, said pleated sidewall including folded, vertically overlapping major and minor fold segments which define a vertically extending reservoir for accumulating moisture, the major and minor fold segments being partitioned by an inwardly disposed upright crease and an outwardly projecting inclined crease, respectively, said outwardly projected inclined crease sloping upwardly and outwardly from said base panel whereby said outwardly projecting crease is inclined with respect to and extends transverse to said inwardly disposed upright crease, thereby defining a reservoir space into which condensate can flow by capillary action.

* * * * *